US007083394B2

(12) United States Patent
Dalton

(10) Patent No.: US 7,083,394 B2
(45) **Date of Patent: *Aug. 1, 2006**

(54) VANE PUMP WITH UNDERVANE FEED

(75) Inventor: William H. Dalton, Amston, CT (US)

(73) Assignee: Goodrich Pump & Engine Control Systems, Inc., West Hartford, CT (US)

( * ) Notice: Subject to any disclaimer, the term of this patent is extended or adjusted under 35 U.S.C. 154(b) by 361 days.

This patent is subject to a terminal disclaimer.

(21) Appl. No.: 10/658,558

(22) Filed: Sep. 8, 2003

(65) Prior Publication Data

US 2004/0047741 A1 Mar. 11, 2004

Related U.S. Application Data

(63) Continuation of application No. 09/966,715, filed on Sep. 28, 2001, now Pat. No. 6,634,865, which is a continuation-in-part of application No. 09/741,524, filed on Dec. 20, 2000, now Pat. No. 6,375,435.

(60) Provisional application No. 60/236,294, filed on Sep. 28, 2000.

(51) Int. Cl.
*F04B 49/00* (2006.01)

(52) U.S. Cl. ..... 417/220; 418/30; 418/82; 418/186; 418/268

(58) Field of Classification Search ..... 417/220, 417/204; 418/82, 26, 30, 267, 268, 269, 418/186, 206, 206.1–206.9
See application file for complete search history.

(56) References Cited

U.S. PATENT DOCUMENTS

| | | | | |
|---|---|---|---|---|
| 2,641,195 | A | 6/1953 | Ferris | 103/136 |
| 2,962,972 | A | 12/1960 | Van Meter | |
| 3,598,510 | A | 8/1971 | Aoki | |
| 3,711,227 | A | 1/1973 | Schmitz | |
| 4,354,809 | A | 10/1982 | Sundberg | 418/268 |
| 4,507,068 | A | 3/1985 | Hayase et al. | |
| 4,556,372 | A | 12/1985 | Leroy et al. | |
| 4,616,984 | A | 10/1986 | Imagaki et al. | |
| 5,064,362 | A | 11/1991 | Hansen | |
| 5,141,418 | A | 8/1992 | Ohtaki et al. | 418/26 |

(Continued)

FOREIGN PATENT DOCUMENTS

| | | |
|---|---|---|
| BE | 445 487 A | 6/1942 |

(Continued)

OTHER PUBLICATIONS

International Search Report dated Apr. 4, 2002.

(Continued)

*Primary Examiner*—Tae (Ted) J Kim
*Assistant Examiner*—Vikansha Dwivedi
(74) *Attorney, Agent, or Firm*—David J. Silvia; Edwards Angell Palmer & Dodge LLP

(57) ABSTRACT

A vane pump is disclosed for use with gas turbine engines which has pressurized fluid supplied to the undervane portion of the vane elements to balance the forces imparted thereon. The vane pump includes a pump housing, a cam member, a cylindrical rotor member and a chamber. The chamber is defined within the housing and positioned for fluid communication with the undervane portion of each vane element to provide a desired pressure thereto. The chamber is in fluid communication with a first pressure source and a second pressure source, wherein the first pressure source is associated with the discharge arc segment of the pumping cavity, and the second pressure source is associated with the inlet arc segment of the pumping cavity.

14 Claims, 8 Drawing Sheets

U.S. PATENT DOCUMENTS

| | | | | |
|---|---|---|---|---|
| 5,154,593 | A | 10/1992 | Konishi et al. | 418/27 |
| 5,490,770 | A | 2/1996 | Oogushi | 418/27 |
| 5,545,014 | A | 8/1996 | Sundberg et al. | 417/204 |
| 5,833,438 | A | 11/1998 | Sundberg | 417/204 |
| 6,015,278 | A | 1/2000 | Key et al. | 418/82 |
| 6,027,323 | A | 2/2000 | Martensen et al. | |
| 6,203,303 | B1 | 3/2001 | Fujiwara et al. | 418/269 |
| 6,655,936 | B1 * | 12/2003 | Szeszulski et al. | 418/82 |

FOREIGN PATENT DOCUMENTS

| | | |
|---|---|---|
| GB | 2 315 815 A | 2/1998 |

OTHER PUBLICATIONS

U.S. Appl. No. 60/236,294.
U.S. Appl. No. 09/741,524.

* cited by examiner

VANE PUMP WITH UNDERVANE FEED

CROSS-REFERENCE TO RELATED APPLICATIONS

This application is a continuation of U.S. patent application Ser. No. 09/966,715, filed Sep. 28, 2001, now U.S. Pat. No. 6,634,865, which is a continuation-in-part of U.S. patent application Ser. No. 09/741,524, filed Dec. 20, 2000, now U.S. Pat. No. 6,375,435, and claims priority to U.S. Provisional Patent Application No. 60/236,294, filed Sep. 28, 2000, both of which are herein incorporated by reference in their entireties to the extent they are not inconsistent with this disclosure.

BACKGROUND OF THE INVENTION

1. Field of the Invention

The subject invention relates to fuel pumps for gas turbine engines, and more particularly, to vane pumps wherein pressurized fluid is supplied to the undervane portion of the vane elements to balance forces imparted thereon.

2. Background of the Related Art

Fixed displacement and variable displacement pumps are used as main fuel pumps in the aviation gas turbine industry. An example of a fixed displacement vane pump is disclosed in U.S. Pat. No. 4,354,809 to Sundberg and a variable displacement vane pump is disclosed in U.S. Pat. No. 5,545,014 to Sundberg et al. The disclosures provided in these patents are herein incorporated by reference to the extent they do not conflict with the present disclosure.

Vane pumps traditionally include a housing, a cam member, a rotor and journal bearings. The housing defines an interior chamber, a fluid inlet and a fluid outlet and the cam member is disposed within the interior chamber of the housing and has a central bore which defines the circumferential boundary of the internal pumping chamber. Mounted for rotational movement within the central bore of the cam member, is a rotor supported by axially opposed journal bearings. Typically, the rotor element has circumferentially spaced apart slots machined therein which support corresponding radially-movable vane elements. The vane elements have a radially outer tip portion which slidably contacts the circumferential portion of the internal pumping chamber and a radially inner undervane portion.

In a single rotation, the vanes of the rotor element of the pump traverse at least four distinct arcuate regions which make up the 360 degree revolution. The first region is the inlet arc segment in which fluid is received into the pumping chamber and over this region the bucket volume increases. The second region is the discharge arc segment in which pressurized fluid is discharged from the pumping chamber and throughout this region, the bucket volume decrease. Lastly, seal arc segments separate the inlet and discharge arc segments and represent the arc segment through which the bucket volume remains substantially constant.

In operation, fluid at a first pressure is fed into the pumping chamber through the housing inlet, and into the space defined between adjacent vane elements, known as the bucket. In positive displacement vane pumps, as the vane elements rotate within the pumping chamber from the inlet region to the outlet region, the configuration of the cam member causes the vanes to retract within the corresponding slots. This causes the volume defined by the bucket to decrease. Since the amount of fluid received into an inlet bucket is greater than that contained within the corresponding discharge bucket, a fluid volume equivalent in size to the volumetric difference is discharged or displaced through the outlet port at a pressure equal to the downstream pressure which must be overcome.

Typically, pumping pressures and velocities are so high within a pump housing that the use of heavy, high wear resistant materials such as tungsten carbide for the vanes and cam member becomes necessary to handle the wear which is caused by these high levels of pressure and velocity.

During this rotation, a radially outward centrifugal force is exerted on the vane elements. At the same time, pressurized fluid within adjacent buckets acts to force the vane elements radially inward. Often, the forces applied to the vanes are not balanced and therefore, the vane tip is either subjected to excessive wear or fluid leaks from within the bucket. This reduces pumping efficiency.

The ideal operating condition for a pump is when the pressure applied to each vane element is balanced and each vane element "floats" within a corresponding slot in the rotor. This condition results in minimum wear to the vane tips and minimum pressure losses due to the lack of contact between the vane tips and the cam member.

Prior attempts at correcting the unbalanced vane condition have included applying pressure to the undervane portion of the vane. In general, the typical vane pump does not incorporate an undervane pumping feature. Those that do, typically supply pressure from within the buckets in the inlet region to the undervane portion of vanes within the inlet arc. Similarly, the undervane portion of the vanes within the discharge arc are supplied with pressure from the buckets located in the discharge arc. This feature creates a balanced condition within the inlet and discharge arc regions, but does not correct the unbalanced condition in the seal arc regions.

When the vanes are in the first seal arc region, which is located after the inlet arc region and before the discharge arc region, the leading face of the vane is subjected to pressure from the discharge side of the pumping chamber and the trailing face is subjected to pressure from the inlet side of the pumping chamber. Therefore supplying pressure from either the inlet or discharge arc regions will not balance the forces. In fact, an interim pressure equal to half the discharge pressure plus half the inlet pressure is required to balance the forces imparted on the vanes traversing the seal arc regions.

Examples of vane pumps having pressure-balanced vanes adapted to provide undervane pumping are disclosed in U.S. Pat. Nos. 4,354,809 and 5,545,014. The '809 patent discloses a vane pump incorporating undervane pumping wherein the vanes are hydraulically balanced in not only the inlet and discharge areas but also in the seal arcs. More specifically, the '809 patent discloses a fixed displacement vane pump which utilizes a series of ports machined in the rotor to supply the pressure to the undervane region. Two ports are provided in the rotor on the leading side of the blade and two ports are provided in the rotor on the trailing side of the blade. All of the ports fluidly communicate with the undervane portion of their associated vane element. Although, this configuration provides a balanced condition, ports having a complex configuration must be machined in the rotor at great expense. Also, in pumps which have a seal arc region with an arc length greater than the arc length between the leading and trailing ports, the pressure supplied to the undervane portion is not a mixture of the pressure from the inlet and discharge arc regions, but rather a mixture of the pressure from the seal arc region and either the discharge or inlet arc regions.

U.S. Pat. No. 5,545,014 to Sundberg et al. teaches a durable, single action, variable displacement vane pump capable of undervane pumping, components thereof and a pressure balancing method which is herein incorporated by reference. The '014 patent discloses the use of a servo-piston to supply half discharge pressure to the undervane portion of the vane elements when the vanes are positioned in the seal arc region.

In view of the foregoing, a need exists for an improved vane pump which cost effectively balances that forces exerted on each vane element in the inlet arc region, the discharge arc region and the seal arc regions.

SUMMARY OF THE INVENTION

The subject application is directed to vane pumps for use with gas turbine engines wherein pressurized fluid is supplied to the undervane portion of the vane elements so as to balance the forces imparted thereon. In a preferred embodiment, the vane pump includes a pump housing, a cam member, a cylindrical rotor member and a chamber. The pump housing has a cylindrical interior chamber formed therein and defines a central axis through which a vertical centerline and a horizontal centerline extend. The cam member is disposed within the interior chamber of the pump housing and has a bore extending therethrough. The bore defines a circumferential surface of a pumping cavity which includes a discharge arc segment, an inlet arc segment and seal arc segments separating the inlet arc segment and the discharge arc segment from one another.

A cylindrical rotor member is mounted for rotational movement within the bore of the cam member, about an axis aligned with the central axis of the interior chamber. The rotor member includes a central body portion which has a plurality of circumferentially spaced apart radially extending vane slots formed therein. Each vane slot supports a corresponding vane element mounted for radial movement therein. Each vane element has a radially outer tip surface adapted for slideably engaging the circumferential surface of the pumping cavity and a radially inner undervane portion within each vane slot.

A chamber is defined within the housing and is positioned for fluid communication with the undervane portion of each vane element and provides a desired pressure thereto. The chamber is in fluid communication with a first pressure source and a second pressure source. The first pressure source is associated with the discharge arc segment of the pumping cavity, and the second pressure source is associated with the inlet arc segment of the pumping cavity.

In a preferred embodiment of the subject invention, the vane pump is a variable displacement vane pump and the cam member is mounted for pivotal movement within the interior chamber of the pump housing about a fulcrum aligned with the vertical centerline of the interior chamber. Alternatively, the vane pump is a fixed displacement vane pump and the cam member is mounted within the pump housing and has a fixed relation with respect to the central axis.

It is envisioned that the circumferential surface of the pump cavity includes an inlet and a discharge arc segment having an arc length of about 150 degrees, and first and second seal arc segments having arc lengths of about 30 degrees However, as would be recognized by those skilled in the art, the arc length of the various segments can vary depending on factors such as the number of inlet and discharge ports and the shape of the circumferential portion of the pumping cavity.

It is further envisioned that in a preferred embodiment of the present invention, the first and second pressure sources are in fluid communication with the chamber each by way of a restrictor. Each restrictor is dimensioned and configured to limit an amount of fluid communicated to the chamber from the first and second pressure sources respectively, thereby creating a desired pressure within the chamber. Also, the chamber is in fluid communication with the undervane portion of each vane element when each vane element passes through the seal arc segments as the rotor member rotates about the central axis.

It is presently preferred that each restrictor is dimensioned and configured to provide a pressure equal to one half of a pressure communicated thereto by the first or second pressure source. In one embodiment, each restrictor includes valve means for selectively controlling the volume of fluid communicated to the chamber by the first and second pressure sources respectively, resulting in the desired pressure within the chamber.

In a preferred embodiment, the vane pump of the present disclosure further includes first and second axially spaced apart end plates which are disposed within the interior chamber of the pump housing. Each end plate has a first surface which is adjacent to the rotor member and forms an axial end portion of the pumping cavity. Each end plate is spaced from the rotor member so as to allow frictionless rotation of the rotor member within the pumping cavity. In this embodiment, the first surface of the first end plate has the chamber and each restrictor is formed therein. Alternatively, and preferably, a chamber and corresponding restrictors can be formed in the first surface of both the first and second end plates. It is also envisioned that first and second channels are formed in the first surface of each end plate. The first channel is configured to provide a path for fluid to communicate from the first pressure source to the restrictor, and the second channel is configured to provide a path for fluid to communicate from the second pressure source to the restrictor.

It is further envisioned that the rotor member can include a plurality of substantially axial fluid passages machined in the central body portion thereof. Each passage is positioned between the plurality of circumferentially spaced apart radial vane slots and provides a path for fluid to communicate axially from the pumping cavity to the first and second end plate.

The present disclosure is also directed to a vane pump which includes a pump housing, a cam member, a cylindrical rotor member and means for providing a pressure to the undervane portions of the vane elements when each vane element rotates through the seal arc segments. Similar to the previously described embodiments, the pump housing has a cylindrical interior chamber which defines a central axis through which a vertical centerline and a horizontal centerline extend. The cam member is disposed within the interior chamber of the pump housing and has a bore extending therethrough. The bore defines a circumferential surface of a pumping cavity which includes a discharge arc segment, an inlet arc segment and seal arc segments separating the inlet arc segment and the discharge arc segment from one another. A cylindrical rotor member is mounted for rotational movement within the bore of the cam member, about an axis aligned with the central axis of the interior chamber. The rotor member includes a central body portion which has a plurality of circumferentially spaced apart radially extending vane slots formed therein, each vane slot supporting a corresponding vane element mounted for radial movement therein.

Unlike the previously described embodiments, this embodiment preferably includes a means for providing a pressure to the undervane portions of the vane elements when each vane element rotates through the seal arc segments. The pressure supplied to the undervane portion of the vane elements is a combination of a first pressure supplied from the discharge arc segment of the pumping cavity and a second pressure supplied from the inlet arc segment of the pumping cavity.

It is presently preferable that the means for providing a pressure to the undervane portions of each vane elements includes a chamber in fluid communication with the first and second pressure sources. Additionally, the first and second pressure sources are each in fluid communication with the chamber each by way of a restrictor. Each restrictor is dimensioned and configured to limit an amount of fluid communicated to the chamber from the first and second pressure sources respectively, thereby creating a desired pressure within the chamber.

The subject application is also directed to a vane pump which includes a pump housing, a cam member, a cylindrical rotor member, first and second axially spaced apart end plates, and first and second pressure chambers.

In a preferred embodiment, the first pressure chamber is formed in the first surface of the first end plate and the second pressure chamber is formed in the first surface of the second end plate. Each chamber is positioned for fluid communication with the undervane portion of each vane element and provides a desired pressure thereto. Each chamber is in fluid communication with a first pressure source and a second pressure source, wherein the first pressure source is associated with the discharge arc segment of the pumping cavity, and the second pressure source is associated with the inlet arc segment of the pumping cavity.

According to the present invention, the pressures acting upon the vanes are balanced so that the vanes are lightly loaded or "floated" throughout the operation of the present pumps. This reduces wear on the vanes, permits the use of thicker, more durable vanes and, most importantly, provides elasto-hydrodynamic lubrication of the interface of the vane tips and the continuous cam surface. Such balancing is made possible by venting the undervane slot areas to an intermediate fluid pressure in the seal arc segments whereby, as each vane is rotated from the low pressure inlet segment to the high pressure discharge segment, and vice versa, the pressure in the undervane slot areas is automatically regulated to an intermediate pressure at the seal arc segments, whereby the undervane and overvane forces are balanced, which prevents the vane elements from being either urged against the cam surface with excessive force or from losing contact with the cam surface.

The regulation of the undervane pressure permits the use of thicker, more durable vanes by eliminating the unbalanced pressures which are found in the prior art. In the prior art, vanes were made thin to limit the loading of the vane against the cam, because relatively high discharge pressure produces the force that urges the vane tip against the cam, while relatively low inlet pressure acts to relieve the interface pressure between the tip and the cam. The small area of the thin vane allows tolerable loads at the vane tip but often requires dense brittle alloys and results in fragile vanes. Within the inlet arcs of the present invention the undervane areas are subjected to inlet pressure as are the overvane areas. Within the outlet arcs of the pump, the undervane areas are subjected to outlet pressure as are the overvane areas. Within the seal arcs of the pump, the undervane areas are subjected to a pressure that is midway between inlet and discharge pressure, to compensate for the overvane areas which are also subjected half to inlet and half to discharge. More importantly, the regulation of the undervane pressure and "floating" of the vanes causes the outer surfaces of the vanes to float over the continuous cam surface which is lubricated by the fluid being pumped, whereby metal-to-metal contact and wear are virtually eliminated. This overcomes the need for hard, brittle, wear-resistant, heavy metals, such as tungsten carbide, for the vanes and/or for the cam surface and permits the use of softer, more ductile, lightweight metals.

Those skilled in the art will readily appreciate that the disclosure of the subject application provides an improved vane pump configuration. The features discussed above and other unique features of the vane pump disclosed herein will become more readily apparent from the following description, the accompanying drawings and the appended claims.

BRIEF DESCRIPTION OF THE DRAWINGS

So that those having ordinary skill in the art to which the present application appertains will more readily understand how to make and use the same, reference may be had to the drawings wherein.

These and other features of the vane pump of the present application will become more readily apparent to those having ordinary skill in the art form the following detailed description of the preferred embodiments.

DETAILED DESCRIPTION OF PREFERRED EMBODIMENTS

Figure 1:
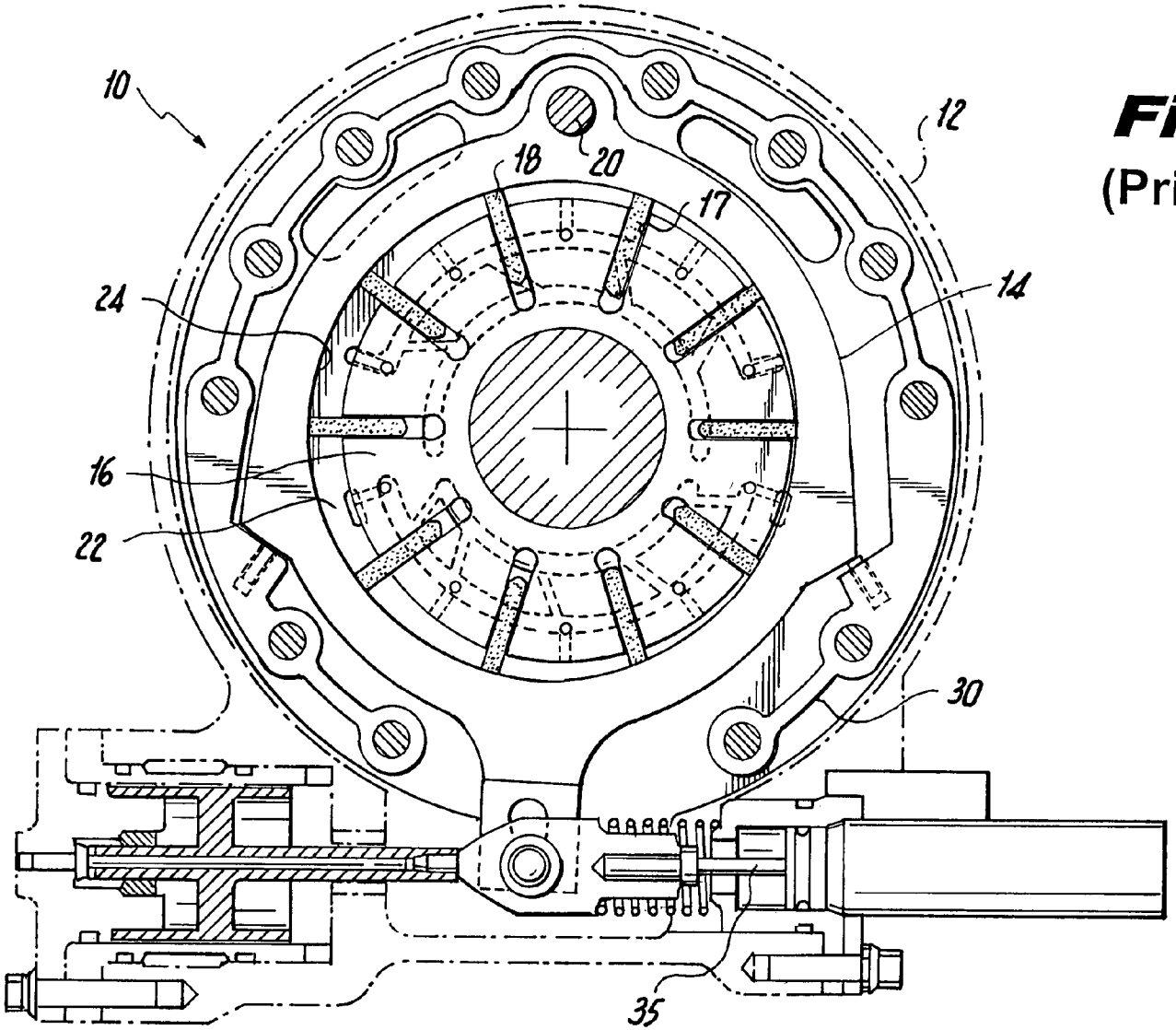
Fig. 1 (Prior Art)
FIG. 1 is a cross-sectional view of a prior art variable displacement vane pump which includes a pump housing, a pivotal cam member, and a rotor member with associated vane elements.

Referring now to the drawings wherein like reference numerals identify similar structural aspects of the subject invention, there is illustrated in FIG. 1 a prior art vane pump designated generally by reference numeral 10. Vane pump 10, which is similar to the pump disclosed in U.S. Pat. No. 5,545,014, includes a pump housing 12 defining an interior chamber which supports a cam member 14 and a rotor member 16. Rotor member 16 includes a plurality of radially extending slots 17. Each slot is configured to support a corresponding vane element 18. Cam member 14 is mounted for pivotal movement about pivot pin 20 and defines a bore 22 forming a cam chamber. The cam chamber defines a cam surface 24 making continuous contact with the outer tip surfaces of the vane elements 18.

Figure 2:
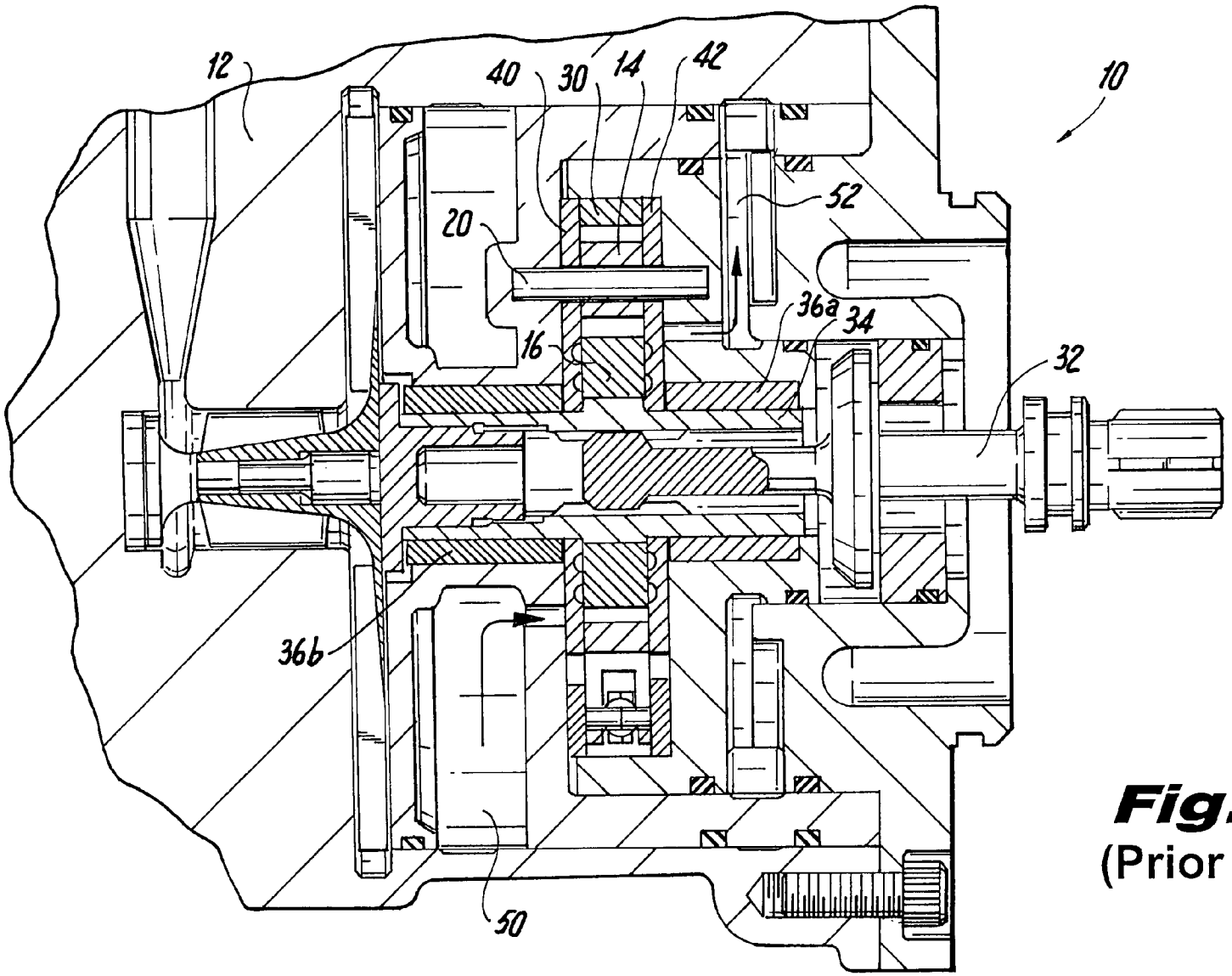
Fig. 2 (Prior Art)
FIG. 2 is a side elevational view in cross-section of the vane pump of FIG. 1 illustrating the manner in which fluid is received into and discharged from the pumping chamber.

Referring to FIG. 2, vane pump 10 further includes an inlet region 50 for admitting low pressure fluid into the pumping chamber and a discharge region 52 for discharging high pressure fluid from the pumping chamber. A main drive shaft 32 extends through the interior chamber of pump housing 12 along the longitudinal axis thereof for driving a central shaft member 34. Shaft member 34 is supported for rotation by opposed journal bearings 36*a* and 36*b*, and is keyed to rotor member 16 for imparting rotational motion thereto.

As illustrated in FIG. 1, vane elements 18 fit snugly within slots 17 and function like pistons as they are depressed radially inwardly during movement of the rotor member through the discharge arc 62 (FIG. 3) of the pumping chamber. Each slot 17 has an radially inner undervane cavity defining an area that is open to inlet pressure when the vane element 18 is in the inlet arc region 60 (FIG. 3) of the pumping chamber, and to discharge pressure when the vane element 18 is in the discharge arc region 62 of the pumping chamber and the seal arc regions 64*a* and 64*b* (FIG. 3) of the pumping chamber. The manner in which pressurized fluid is communicated to the undervane cavity will be described in more detail herein below with respect to FIG. 3.

With continuing reference to FIG. 2, opposed sideplates 40 and 42, which are disposed within the interior chamber, form a sealed cavity between cam member 14 and rotor member 16, and provide inlet and discharge ports for the cavity. Axial spacer 30 is supported within the housing 12, between sideplates 40 and 42, and has a thickness that is slightly greater than the thickness of cam member 14. This allows the sideplates 40 and 42 to be tightly clamped against the spacer 30 by a plurality of threaded fasteners (not shown) while allowing small gaps to remain between the cam member 14 and the sideplates to reduce or eliminate friction therebetween.

Figure 3:
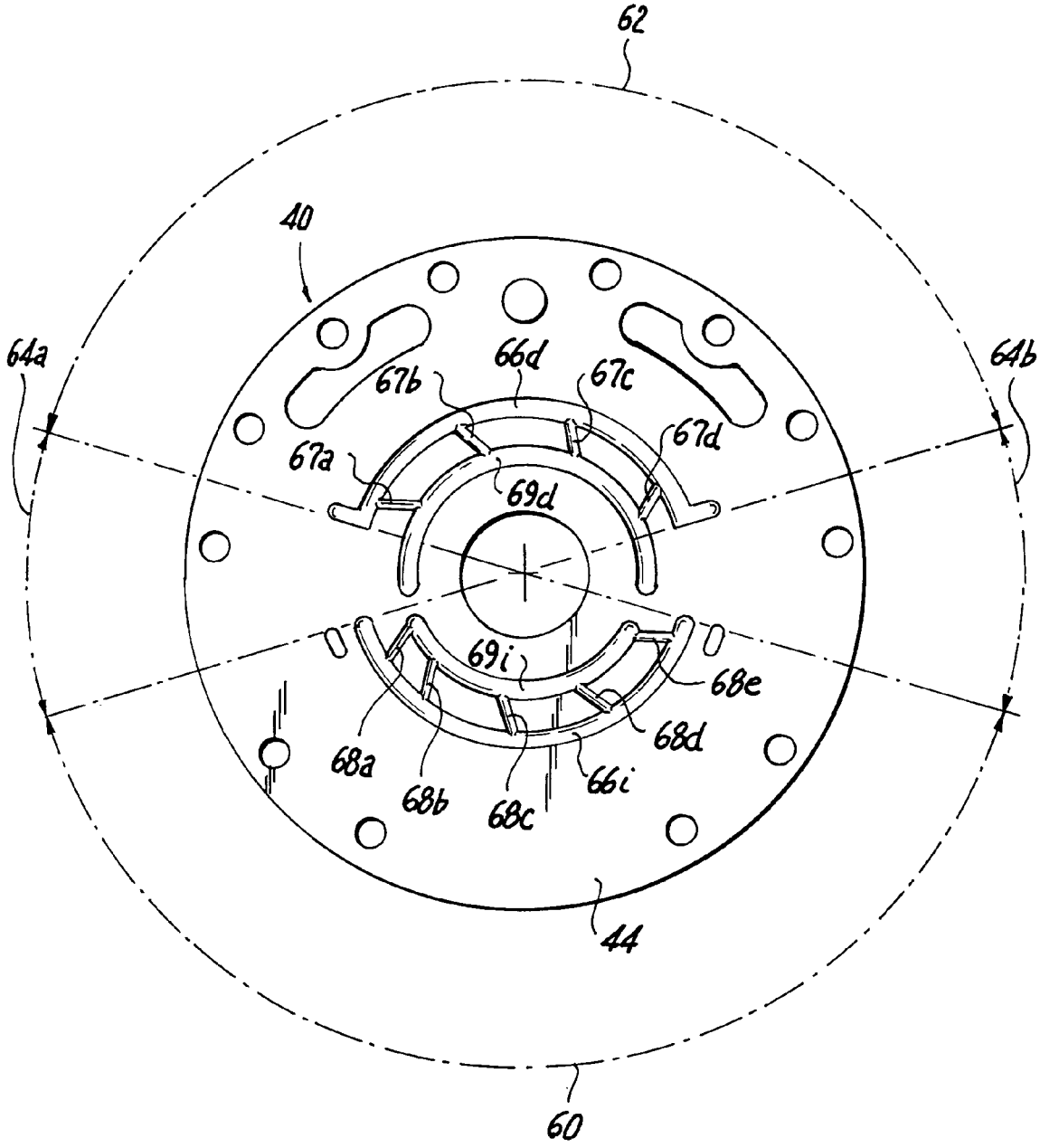
Fig. 3 (Prior Art)
FIG. 3 is plan view of the face of an end plate of the vane pump of FIGS. 1 and 2, the face having a series of recesses formed therein for communicating fluid from either the high pressure and low pressure regions of the pumping cavity to the undervane portion of each vane element.
Figure 4:
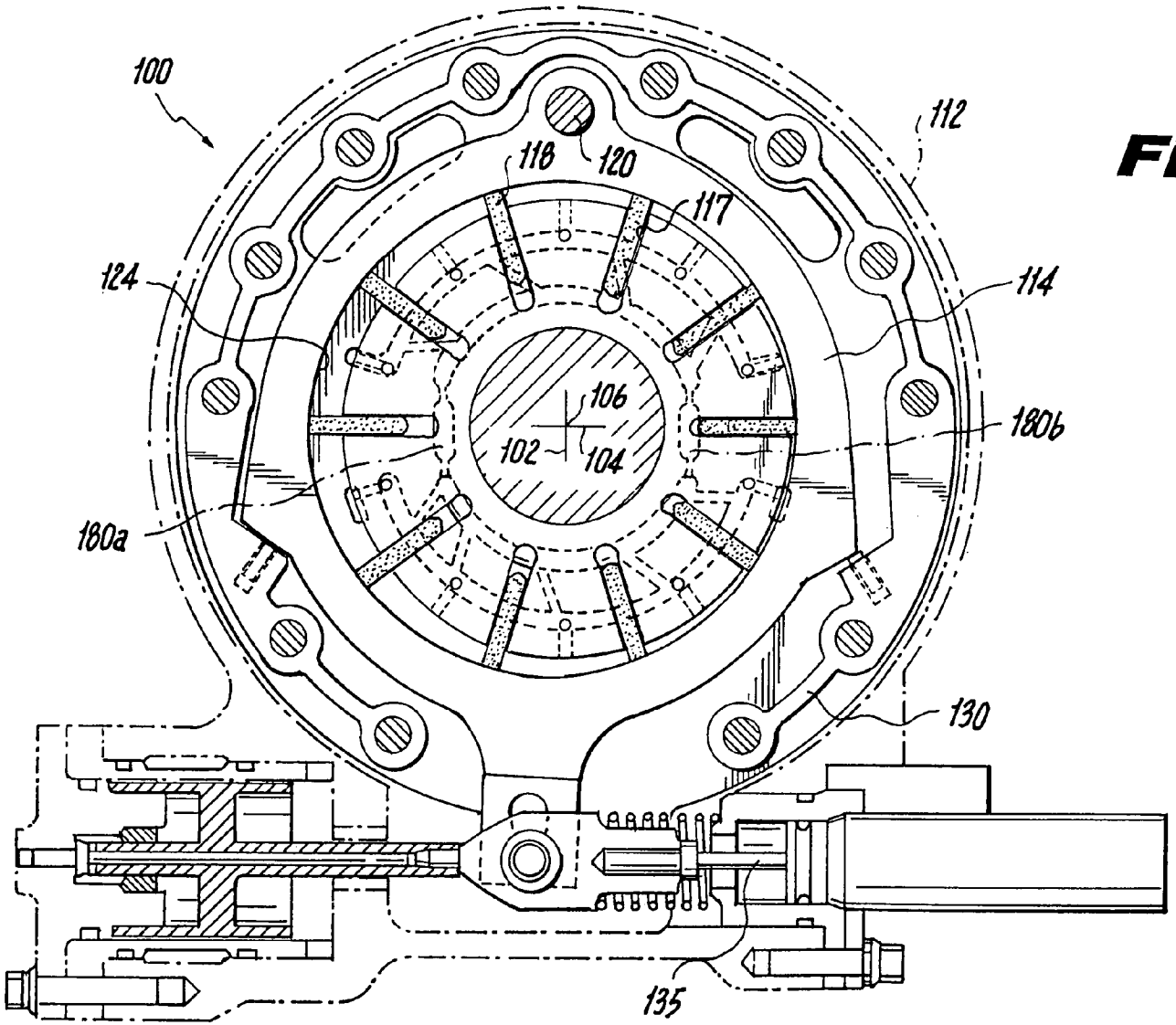
FIG. 4 is a cross-sectional view of a variable displacement vane pump constructed in accordance with a preferred embodiment of the present application, the vane pump including a pump housing, a pivotal cam member, and a rotor member with associated vane elements.

Referring now to FIG. 3, surface 44 of side plate 40 is disposed adjacent rotor member 16 (not shown). The 360 degree pumping chamber includes an inlet arc region 60, a discharge arc region 62 and sealing arc regions 64*a* and 64*b* positioned between the inlet and discharge arc regions 60 and 62. The inlet arc region 60 represents the portion of the pumping chamber in which the volume contained between adjacent vane elements (i.e., within the buckets) increases and fluid is received into the pumping chamber. The discharge arc region 62 is the portion of the pumping chamber in which the volume contained between adjacent vane elements decreases. In the seal arc regions 64*a* and 64*b*, the volume remains substantially constant.

When the rotor 16 rotates within the pumping chamber, the centrifugal force created thereby imparts a radially outward force on each vane elements 18. In addition, the pressurized fluid contained within adjacent buckets imparts a radially inward force on the adjacent vane elements. Often, the opposed forces which are applied to the vane elements 18 are not balanced. As a result, the vane tip of each vane 18 is either subjected to excessive wear due to a net radially outward force or fluid leaks from within the bucket due to a net radially inward force. This reduces pumping efficiency. An ideal situation occurs when the pressure applied to the vane elements is balanced and the vane elements "float" within the slots defined in the rotor. This condition results in minimum wear to the vane tips and minimizes the pressure losses caused by the lack of contact between the vane tips and the cam member.

With continuing reference to FIG. 3, pump 10 is adapted and configured to correct the unbalanced vane condition by applying pressure to the undervane portion of the vane. More specifically, pressure from within each bucket traversing the inlet region 60 is supplied to the undervane portion of vanes within the inlet arc region 60. Similarly, the undervane portion of the vanes traversing the discharge arc region 62 is supplied with pressure from the buckets located in the discharge arc region 62. The pressure, in the form of pressurized fluid, is supplied from the inlet arc region 60 and discharge arc region 62 by arcuate channels 66*i* and 66*d*, respectively. Channels 66*i* and 66*d* are formed in face 44 of endplate 40 and are in fluid communication with the inlet and discharge arc regions, 60 and 62, respectively. Fluid from the inlet arc region 60 is received into chamber 66*i* and then flows radially inward through passages 68*a–e* to inner channel 69*i*. The passages 68*a–e* and the inner channel 69*i* are machined into face 44 of side plate 40.

Inner channel 69*i* communicates with the undervane portion of each vane element 18 positioned within the inlet arc region 60. In a similar manner, on the discharge side of the pumping chamber, fluid from within the discharge arc region 62 is received by arcuate channel 66*d*. The fluid then flows radially inward through passages 67*a–d* to inner channel 69*d*. As before, the passages 67*a–d* and the inner channel 69*d* are each machined into face 44 of side plate 40. Arcuate channel 69 communicates with the undervane portion of each vane element 18 positioned within the discharge arc region 62 and the sealing arc regions 64*a* and 64*b*.

The undervane pumping feature disclosed in FIGS. 1 through 4 creates a balanced condition with the inlet and discharge arc regions 60 and 62, but does not correct the unbalanced condition in the seal arc regions 64*a* and 64*b*. In the seal arc regions 64*a* and 64*b*, the net force on the vane 18 is radially outward. For example, when the vanes 18 are in the seal arc region 64*a*, the leading face of the vane is subjected to pressure from the discharge arc side 62 of the pumping chamber and the trailing face is subjected to pressure from the inlet arc side 60 of the pumping chamber. Therefore, supplying pressure from the discharge arc region 62 to the undervane portion of vane elements 18 which are traversing through the seal arc region 64*a* will not balance the forces imparted thereon. In fact, an interim pressure equal to half discharge pressure plus half inlet pressure is required to balance the forces.

Referring now to FIGS. 4 through 8 which illustrate a vane pump constructed in accordance with a preferred embodiment of the present disclosure and designated generally by reference numeral 100. It should be noted that similar structural elements to those previously described are identified by similar reference numerals. Vane pump 100 is a variable displacement vane pump having a cam member 114 mounted for pivotal movement within the interior chamber 113 of pump housing 112 about a fulcrum aligned with the vertical centerline 102 of the interior chamber 113. As would be appreciated by those skilled in the art, the inventive aspects disclosed herein and applied to vane pump 100 can be applied to a fixed displacement vane pump in which the cam member is mounted within the pump housing and is fixed with respect to the central axis. Also, the inventive aspects disclosed herein can also be applied to variable or fixed displacement vane pumps which have multiple inlet or discharge regions and a plurality of seal arc regions.

Vane pump 100 includes a pump housing 112, a cam member 114, a cylindrical rotor member 116 and first and second chambers 180*a* and 180*b*. The pump housing 112 has a cylindrical interior chamber 113 formed therein and defines a central axis 106 through which a vertical centerline 102 and a horizontal centerline extend 104. The cam member 114 is disposed within the interior chamber 113 of the pump housing 112 and has a bore extending therethrough. The bore defines a circumferential surface 124 of a pumping cavity which includes a discharge arc segment 162, an inlet arc segment 160 and seal arc segments 164*a* and 164*b* separating the inlet arc segment 160 and the discharge arc segment 162 from one another.

Figure 8:
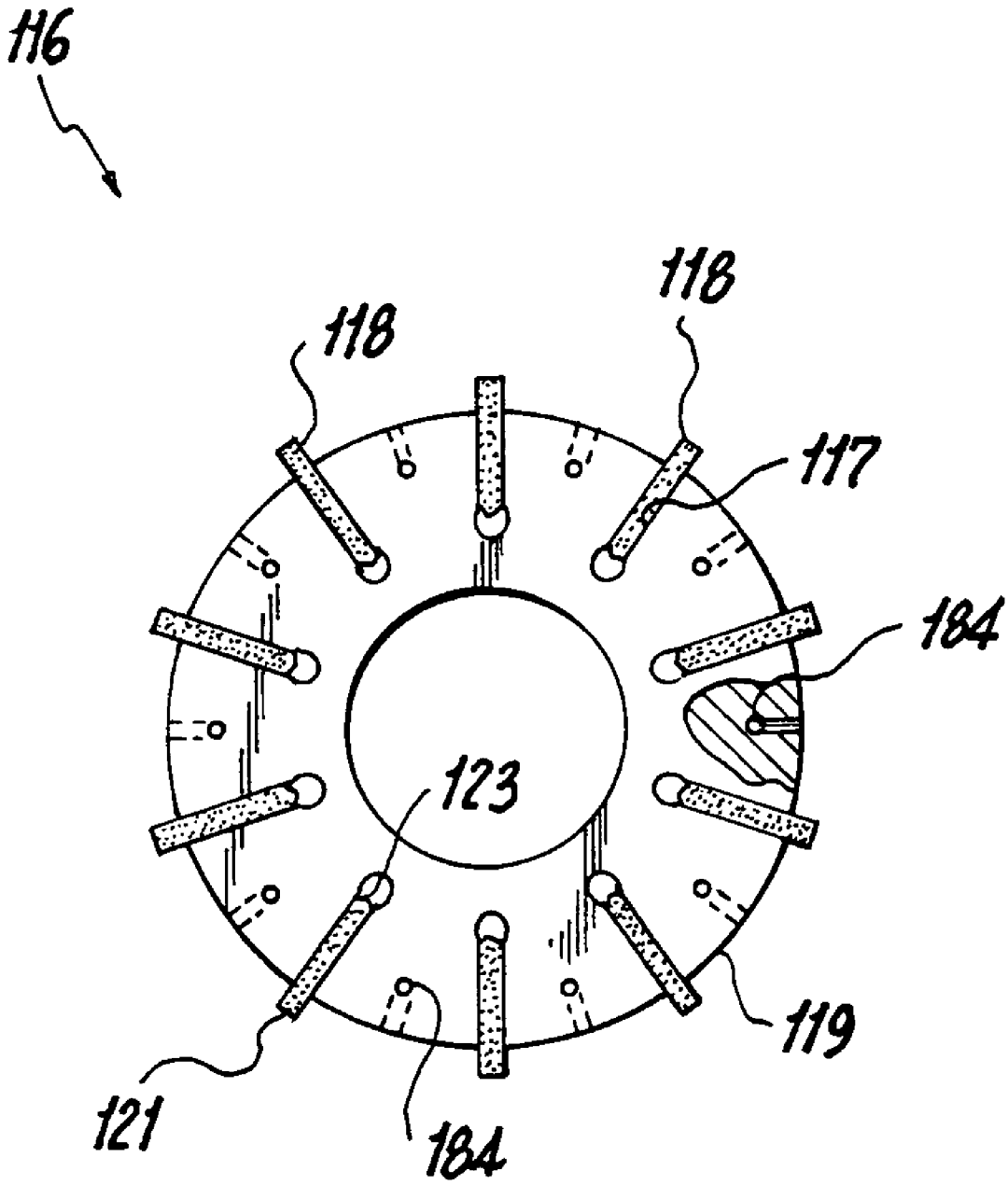
FIG. 8 is a cross-sectional view of a rotor member constructed in accordance with a preferred embodiment of the present application.

A cylindrical rotor member 116 is mounted for rotational movement within the bore of the cam member 114, about an axis aligned with the central axis 106 of the interior chamber 113. As illustrated in FIG. 8, the rotor member 116 includes a central body portion 119 which has a plurality of circumferentially spaced apart radially extending vane slots 117 formed therein. Each vane slot 117 supports a corresponding vane element 118 mounted for radial movement therein. Each vane element has a radially outer tip surface 121 adapted for slideably engaging the circumferential surface 124 of the pumping cavity and a radially inner undervane portion 123 within each vane slot 117.

Figure 5:
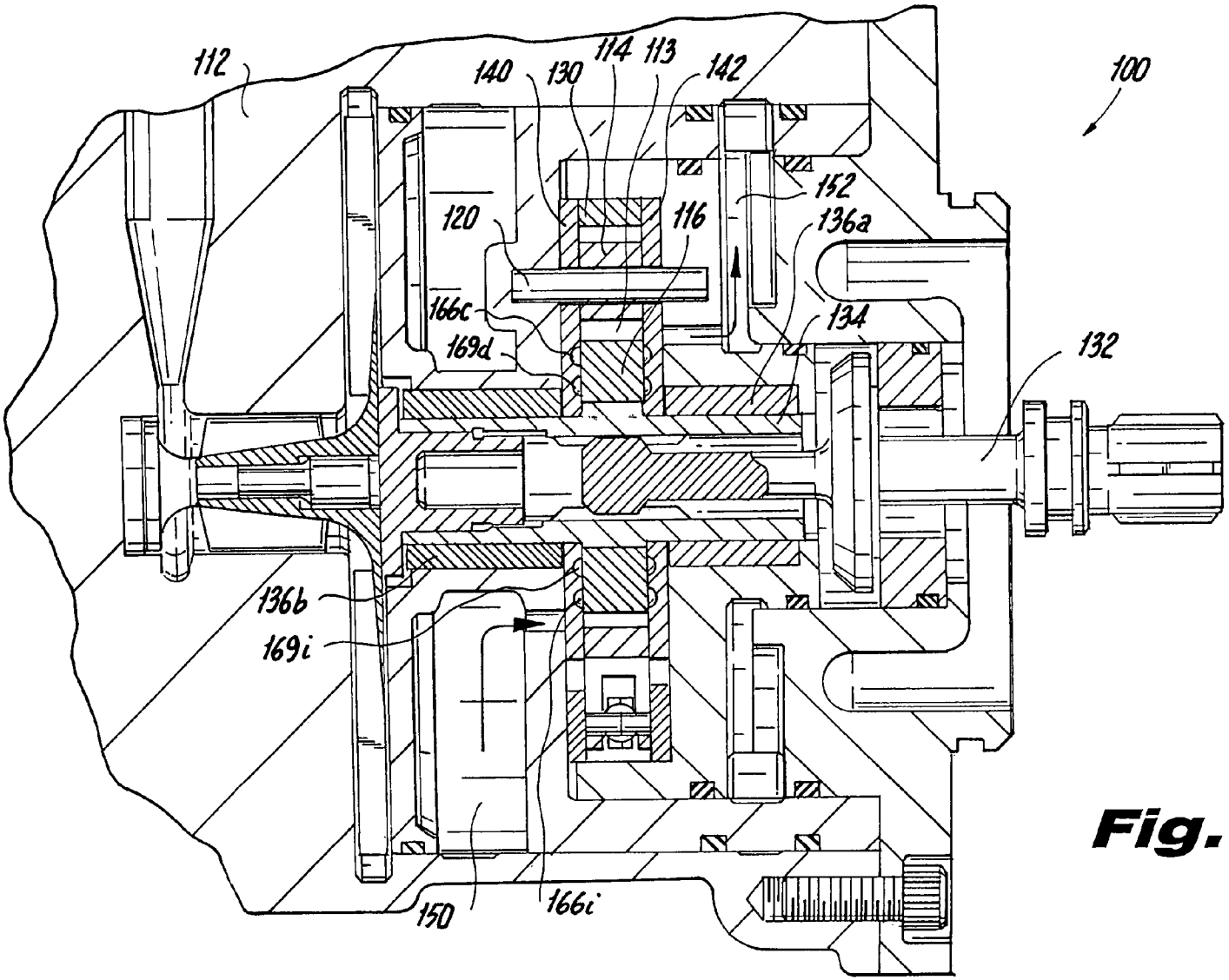
FIG. 5 is a side elevational view in cross-section of the vane pump of FIG. 4 illustrating the drive mechanism for the pump and the axial opposed end plates disposed within the interior chamber of the pump housing and forming the ends of the pumping cavity.

Referring to FIG. 5, opposed end plates 140 and 142, which are disposed within the interior chamber 113, form a sealed cavity between cam member 114 and rotor member 116, and provide inlet and discharge ports for the cavity. An axial spacer 130, having a thickness that is slightly greater than the thickness of cam member 114 and is disposed between end plates 140 and 142. This allows the end plates 140 and 142 to be tightly clamped against the spacer 130 by a plurality of threaded fasteners (not shown) while allowing small gaps to remain between the cam member 114 and the end plates to reduce or eliminate friction therebetween.

Figure 6:
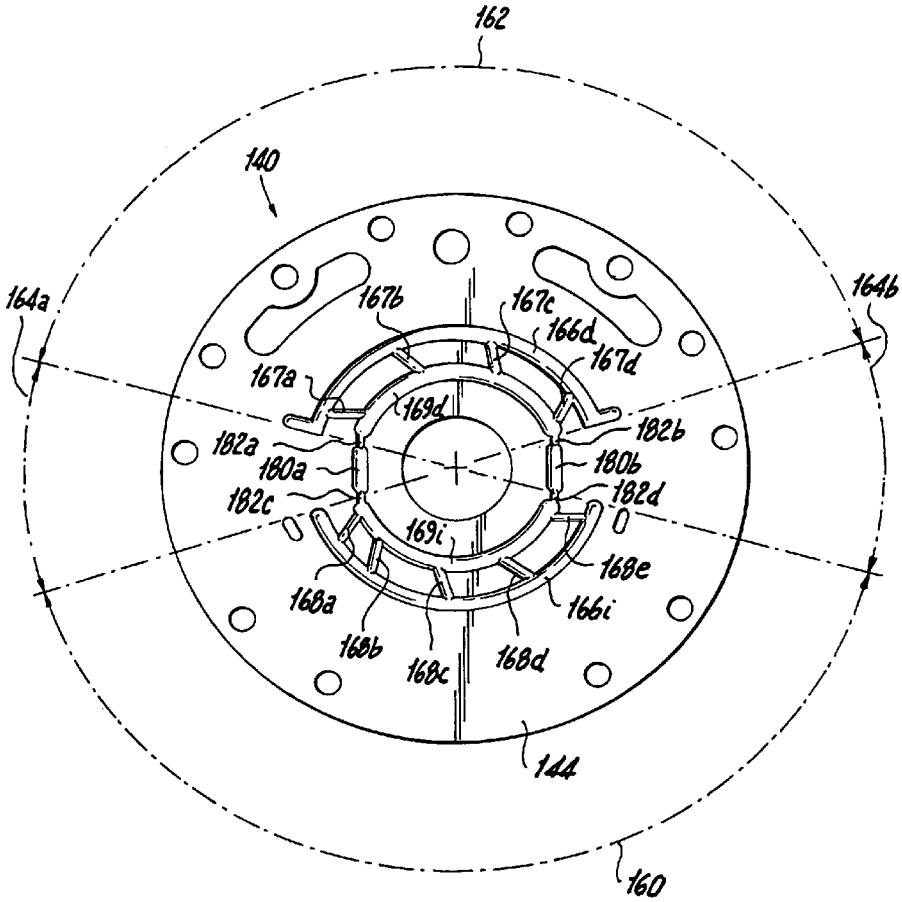
FIG. 6 is a side view of the face of the end plate of FIG. 5 illustrating a series of channels and: recesses and two chambers formed in the face.

With reference to FIG. 6, the surface 144 of side plate 140 is disposed adjacent to rotor member 116. As noted, the 360 degree pumping chamber includes an inlet arc region 160, a discharge arc region 162 and sealing arc regions 164*a* and 164*b* positioned between the inlet and discharge arc regions 160 and 162. The inlet arc region 160 represents the portion of the pumping chamber in which the volume contained between adjacent vane elements 118 or within the "buckets" increases and fluid is received into the pumping chamber. The discharge arc region 162 is the portion of the pumping chamber in which the volume contained in the buckets decreases. In the seal arc regions 164*a* and 164*b*, the volume remains substantially constant.

As discussed above with respect to FIG. 3, an ideal situation occurs when the pressure applied to the vane elements is balanced and the vane elements "float" within the slots defined in the rotor. This condition results in minimum wear to the vane tips and minimum pressure losses due to the lack of contact between the vane tips and the cam member. Vane pump 10 balanced the vanes in the inlet and discharge arc region 160 and 162, but not in the seal arc regions 164*a* and 164*b*.

Vane pump 100 as shown in FIGS. 4 through 8 is configured in such a manner so that the forces imparted on each vane element 118 in all of the regions of the pump are balanced. When the vane elements 118 are in the inlet arc region 160, the undervane portion 123 of each vane element 118 is supplied with pressurized fluid from the inlet arc region 160. Similarly, the undervane portion 123 of each vane elements positioned in the discharge arc region 162 is supplied with pressurized fluid from the discharged arc region 162.

The pressure is supplied from the inlet arc region 160 and discharge arc region 162 by arcuate channels 166*i* and 166*d* respectively. Channels 166*i* and 66*d* are formed in face 144 of endplate 140 and are in fluid communication with the inlet and dischrage arc regions, 160 and 162 respectively. Fluid from the inlet arc region 160 is received into chamber 166*i* and then proceeds to flow radially inward through passages 168*a–e* to inner channel 169*i*, the passages 168*a–e* and the inner channel 169*i* being machined into face 144 of endplate 140. Inner channel 169*i* communicates with the undervane portion of each vane element 118 which is positioned within the inlet arc region 160. In a similar manner, on the discharge side of the pumping chamber, fluid from within the discharge arc region 162 is received into arcuate chamber 166*d*. The fluid then flows radially inward through passages 167*a–d* to inner channel 169*d*. The passages 167*a–d* and the inner channel 169*d* are each machined into face 144 of endplate 140. Arcuate channel 169*d* communicates with the undervane portion of each vane element 118 positioned within the discharge arc region 162. One skilled in the art would readily appreciate that the quantity of channels and passages can be varied depending on the configuration of the pump and the associated operating pressures.

As illustrated most clearly in FIG. 6, chambers 180*a* and 180*b* are also defined in end plate 140 and are positioned for fluid communication with the undervane portion 123 of each vane element 118 when each vane element 118 is positioned within the seal arc regions 164*a* and 164*b*. Each chamber 180*a* and 180*b* is in fluid communication with a first pressure source and a second pressure source. The first pressure source is associated with the discharge arc region 162 of the pumping cavity, and the second pressure source is associated with the inlet arc region 160 of the pumping cavity.

As shown in FIG. 6, the arc length of the inlet and discharge arc segments 160 and 162 is about 150 degrees. The seal arc segments 164*a* and 164*b* have an arc length of about 30 degrees. The arc length of the various segments can vary depending on factors such as the number of inlet and discharge port and the shape of the surface pumping cavity.

With continuing reference to FIG. 6, the first and second pressure sources are in fluid communication with each chamber 180*a* and 180*b* by way of respective restrictors, 182*a–d*. Restrictors 182*a* and 182*c* are dimensioned and configured to limit an amount of fluid communicated to chamber 180*a* from the first and second pressure sources, respectively, thereby creating a desired pressure within chamber 180*a*. In a similar manner, restrictors 182*b* and 182*d* are dimensioned and configured to control the amount of fluid that is received into chamber 180*b* from the first and second pressure sources. As a result, the fluid pressure in chambers 180*a* and 180*b* is a selected combination of the fluid which is located in the inlet arc region 160 and the discharge arc region 162. Therefore, the chambers 180*a* and 180*b* supply fluid having an interim or desired pressure to the undervane portion 123 of each vane element 118 when each vane element passes through the seal arc segments 164*a* and 164*b* as the rotor member 116 rotates about the central axis 106.

In the embodiment illustrated in FIG. 6, each restrictor 182*a–d* is dimensioned and configured to provide a pressure equal to about one half of a pressure communicated thereto by the first or second pressure source. More specifically, the size of the passage which defines each restrictor is selected to allow the pressure in the corresponding chamber to be equal to the average of the sum of the pressures from the inlet and discharge arc regions 160 and 162. This interim pressure applied to the undervane portion 123 of the vane elements 118 creates a balanced condition in the seal arc regions 164*a* and 164*b*.

Figure 7:
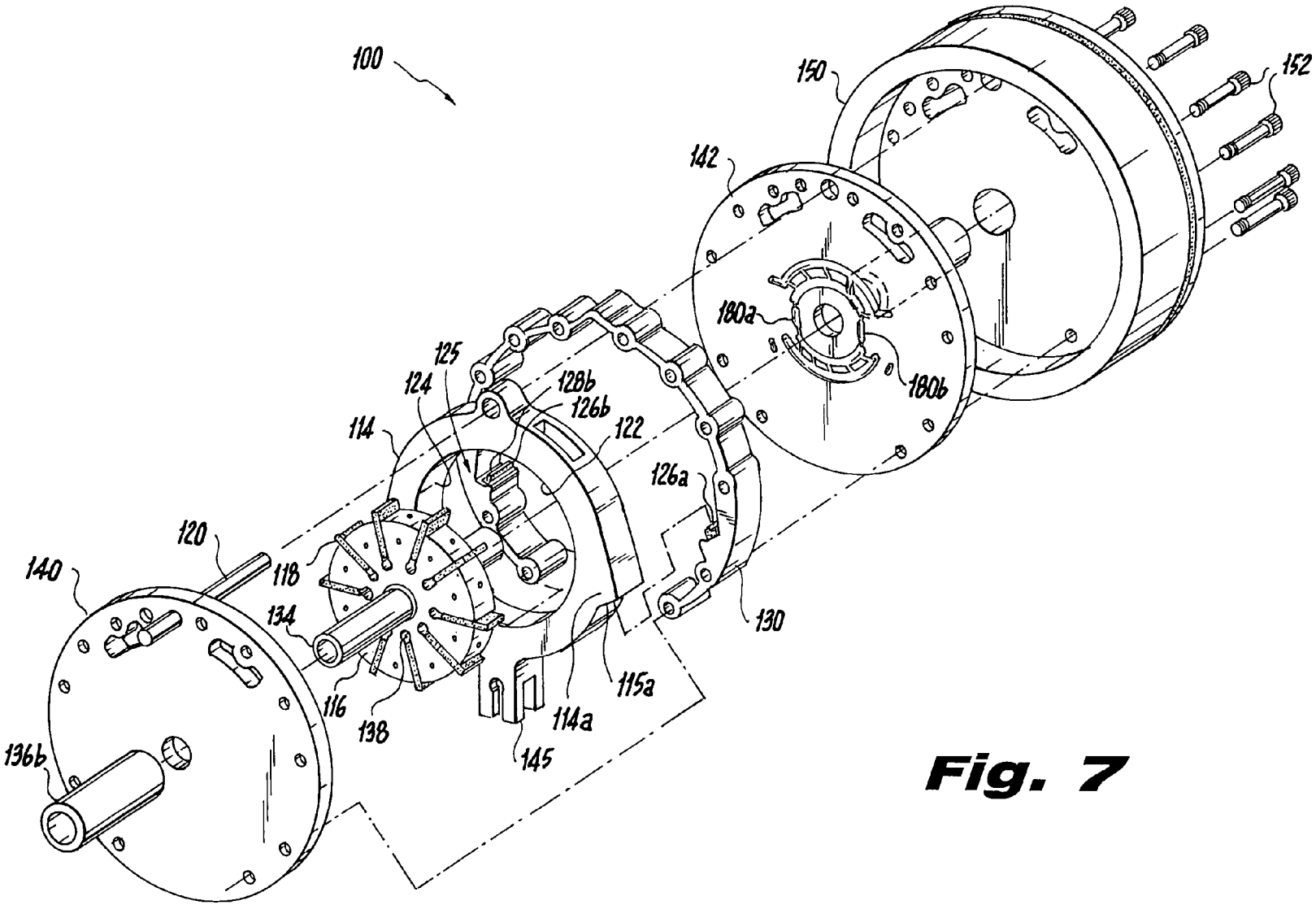
FIG. 7 is a partially exploded perspective view of the vane pump of FIGS. 4 and 5 with parts separated for ease of illustration.

Referring to FIG. 7, rotor 116 includes a plurality of substantially axial fluid passages 184 machined in the central body portion 119 thereof. Each passage 184 is positioned between the plurality of circumferentially spaced apart radial vane slots 117 and provides a path for fluid to flow from the pumping cavity to the channels 166*i* and 166*d* formed in end plates 140, or in both end plate 140 and 142.

This feature is advantageous because fluid must travel radially inward from the bucket into each passage 184, against the centrifugal force created by the rotation, so that the fluid is effectively filtered prior to entering each passage 184. Moreover, particulate contained within the fluid in the pumping chamber is forced radially outward by the centrifugal motion, leaving particulate free fluid on the radially inner portion of the bucket.

While the invention has been described with respect to preferred embodiments, those skilled in the art will readily appreciate that various changes and/or modifications can be made to the invention without departing from the spirit or scope of the invention as defined by the appended claims.

What is claimed is:

1. A vane pump comprising:

a housing having an interior chamber with a rotor rotatably mounted therein;

a cam pivotally mounted about the rotor and defining a pumping chamber within the interior chamber, the pumping chamber having an inlet arc region, a discharge arc region and sealing arc regions angularly extending at least about 30 degrees positioned between the inlet and discharge arc regions;

a plurality of vane elements slideably supported within a plurality of radially extending slots formed in the rotor such that as the rotor rotates a radially outward centrifugal force is imparted to each vane element, wherein in the sealing arc regions the radially outward centrifugal force positions the vane elements radially outward;

a sideplate mounted within the interior chamber having first and second opposing surfaces, the first surface being disposed adjacent the rotor of the vane pump, the first surface defining channels in fluid communication with the inlet and discharge arc regions for supplying pressurized fluid within the plurality of radially extending slots for providing an undervane force to balance each vane element so as to balance forces imparted thereon when each vane element is in the sealing arc region.

2. A vane pump as recited in claim 1, wherein the pressurized fluid flows radially inwardly to the plurality of radially extending slots.

3. A vane pump as recited in claim 1, wherein the first surface of the sideplate also forms a plurality of restrictors, each restrictor dimensioned and configured to limit an amount of pressurized fluid passing within the plurality of radially extending slots.

4. A vane pump as recited in claim 1, further comprising a second sideplate axially spaced from the first sideplate, the second sideplate having opposing first and second surfaces wherein the first surface of the second sideplate is adjacent the rotor.

5. A vane pump as recited in claim 1, wherein each sideplate is spaced from the rotor so as to allow frictionless rotation of the rotor.

6. A vane pump as recited in claim 1, wherein the discharge arc region is approximately 150 degrees.

7. A vane pump as recited in claim 1, wherein the inlet arc region is approximately 150 degrees.

8. A vane pump comprising:

a) a pump housing defining a cylindrical interior chamber, b) a cam member disposed within the interior chamber of the pump housing and having a bore extending therethrough and defining a circumferential surface of a pumping cavity, the circumferential surface of the pumping cavity including a discharge arc segment, an inlet arc segment and seal arc segments separating the inlet arc segment and the discharge arc segment from one another;

c) a cylindrical rotor member mounted for rotational movement within the bore of the cam member about an axis, the rotor member having a central body portion which includes a plurality of circumferentially spaced apart radially extending vane slots formed therein, each vane slot supporting a corresponding vane element mounted for radial movement therein, each vane element having a radially outer tip surface adapted for slideably engaging the circumferential surface of the pumping cavity and a radially inner undervane portion within each vane slot;

d) a mixing chamber defined within the pump housing and positioned for fluid communication with the radially inner undervane portion of each vane element and providing a pressure thereto when the vane elements passes through the seal arc segments, the mixing chamber being in fluid communication with a first pressure source and a second pressure source, wherein the first pressure source is associated with the discharge arc segment of the pumping cavity by way of a first restrictor passage, and the second pressure source is associated with the inlet arc segment of the pumping cavity by way of a second restrictor passage; and e) valve means associated with the first and second restrictors, respectively, for selectively controlling a volume of fluid communicated to the mixing chamber by the first and second pressure sources, respectively.

9. A vane pump as recited in claim 8, wherein the pump is a variable displacement vane pump and the cam member is mounted for pivotal movement within the interior chamber of the pump housing about a fulcrum.

10. A vane pump as recited in claim 8, wherein the pump is a fixed displacement pump.

11. A vane pump as recited in claim 8, wherein each restrictor is dimensioned and configured to provide a pressure equal to about one half of a pressure communicated thereto by the first and second pressure sources.

12. A vane pump as recited in claim 8, further comprising first and second axially spaced apart end plates disposed within the interior chamber of the pump housing, each end plate having a first surface which is adjacent to the rotor member, each first surface forming an axial end portion of the pumping cavity, each end plate spaced from the rotor member so as to allow rotation of the rotor member with the pumping cavity.

13. A vane pump as recited in claim 12, wherein the first surface of the first end plate has the mixing chamber and each restrictor formed therein.

14. A vane pump as recited in claim 12, wherein first and second channels are formed in the first surface of each end plate, the first channel being configured to provide a path for fluid to communicate from the first pressure source to the restrictor, and the second channel being configured to provide a path for fluid to flow from the second pressure source to the restrictor.

* * * * *